US011097824B1

(12) United States Patent
Anderson, Jr.

(10) Patent No.: US 11,097,824 B1
(45) Date of Patent: Aug. 24, 2021

(54) OUTBOARD MOTOR HAVING COPILOT DEVICE

(71) Applicant: Brunswick Corporation, Mettawa, IL (US)

(72) Inventor: Donald T. M. Anderson, Jr., Siren, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/783,795

(22) Filed: Feb. 6, 2020

(51) Int. Cl.

| | |
|---|---|
| ***B63H 20/12*** | (2006.01) |
| ***B63H 20/00*** | (2006.01) |
| ***B63H 20/06*** | (2006.01) |
| *B63H 25/02* | (2006.01) |

(52) U.S. Cl.
CPC ..... *B63H 20/12* (2013.01); *B63H 20/06* (2013.01); *B63H 21/265* (2013.01); *B63H 25/02* (2013.01)

(58) Field of Classification Search
CPC ..... B63H 20/12; B63H 20/06; B63H 21/265; B63H 25/02
See application file for complete search history.

(56) References Cited

U.S. PATENT DOCUMENTS 1,451,452 A * 4/1923 Williams ..... B63H 20/12 74/486
4,521,201 A * 6/1985 Watanabe ..... B63H 21/265 114/144 R
4,701,141 A * 10/1987 Sumigawa ..... B63H 21/265 114/144 R
5,180,319 A 1/1993 Shiomi
5,582,527 A 12/1996 Nakamura
6,146,221 A 11/2000 Natsume
6,174,211 B1 1/2001 Nakamura
6,283,806 B1 9/2001 Schmidt et al.
6,902,450 B2 6/2005 Ohtsuki et al.
(Continued)

FOREIGN PATENT DOCUMENTS

CN 206590092 10/2017
JP 3976290 8/1976

OTHER PUBLICATIONS

Evinrude, Evinrude E-Tec 25 HP, last accessed May 11, 2021, available at: https://www.evinrude.com/en-US/e-tec/e-tec-full-specs.html#tab=12.

(Continued)

*Primary Examiner* — Stephen P Avila
(74) *Attorney, Agent, or Firm* — Andrus Intellectual Property Law, LLP

(57) ABSTRACT

An apparatus is for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

19 Claims, 12 Drawing Sheets

(56) References Cited

U.S. PATENT DOCUMENTS

| | | | |
|---|---|---|---|
| 7,244,152 | B1 | 7/2007 | Uppgard |
| 7,303,595 | B1 | 12/2007 | Janitz |
| 7,681,513 | B1 | 3/2010 | Hundertmark |
| 7,896,304 | B1 | 3/2011 | Eichinger et al. |
| 8,069,803 | B1 | 12/2011 | Crawford |
| 8,795,010 | B1 | 8/2014 | Wiatrowski |
| 8,820,701 | B1 | 9/2014 | Eichinger |
| 9,205,906 | B1 | 12/2015 | Eichinger |
| 9,376,191 | B1 | 6/2016 | Jaszewski |
| 9,463,859 | B1 | 10/2016 | Cooper, III et al. |
| 9,481,434 | B1 | 11/2016 | Eichinger et al. |
| 9,643,703 | B1 | 5/2017 | Eichinger |
| 9,701,383 | B1 | 7/2017 | Stuber et al. |
| 9,764,813 | B1 | 9/2017 | Zarembka et al. |
| 9,783,278 | B1 | 10/2017 | Dannenberg et al. |
| 9,789,945 | B1 | 10/2017 | Vaninetti et al. |
| 9,963,213 | B1 | 5/2018 | Jaszewski et al. |
| 9,969,475 | B1 | 5/2018 | Waisanen |
| 10,005,536 | B2 | 6/2018 | Fukuchi |
| 10,124,871 | B1 | 11/2018 | Eichinger et al. |
| 10,246,173 | B1 | 4/2019 | Ingebritson |
| 10,464,648 | B1 | 11/2019 | Amerling et al. |
| 2009/0001244 | A1 | 1/2009 | Lucier et al. |
| 2009/0170384 | A1 | 7/2009 | Balogh et al. |

OTHER PUBLICATIONS

Evinrude, Evinrude E30DTSLAFD Tiller Arm Diagram, last accessed May 11, 2021, available at: https://www.boats.net/catalog/evinrude/outboard-by-year/af-models/e30dtslafd/tiller-arm.

Honda Marine, BF25D•BF30D Owner's Manual, 2017 Honda Motor Co., Ltd.

Honda Marine, Honda Marine BF25hp Parts List, last accessed Dec. 4, 2018, available at: http://peparts.honda.com/marine#/serial.

Honda Marine, Honda BF25-30hp, last accessed May 11, 2021, available at: https://marine.honda.com/outboards/motor-detail/BF25-30#specs.

Mercury Marine, 2010 Mercury Marine 25hp Owner's Manual.

Mercury Marine, 2015 Mercury Marine 15/20 FourStroke Outboard Installation Operation Maintenance Warranty Manual.

Suzuki Motor Corporation, DF25A-DF30A Owner's Manual, Oct. 2015.

Suzuki Motor Corporation, Suzuki DF 30A Parts Listings, last accessed Dec. 4, 2018, available at: https://www.brownspoint.com/store/pc/BP_AP_AssemblyDetail.asp?ID=19761.

Yamaha Motor Co., Ltd., Yamaha 25hp Parts List, last accessed Dec. 4, 2018, available at: https://shop.yamahaonlineparts.com/OEMpartfinder.htm.

Yamaha Motor Co., Ltd., Yamaha F25 T25 Owner's Manual, May 2013.

Yamaha Motor Co., Ltd., 2013 Yamaha Outboard 30hp—F30LA Steering Friction Section, last accessed Dec. 4, 2018, available at: https://www.crowleymarine.com/yp/KE329296/steering-friction-f30la-2013-30hp.

Yamaha Motor Co., Ltd., 2013 Yamaha Outboard 30hp—F30LA, Bracket 1 Section, last accessed Dec. 4, 2018, available at: crowleymarine.com.

Yamaha Motor Co., Ltd.,Yamaha 30hp Co-Pilot Manual, Feb. 2010.

* cited by examiner

OUTBOARD MOTOR HAVING COPILOT DEVICE

FIELD

The present disclosure relates to outboard motors for propelling a marine vessel in water, and more particularly to apparatuses for steering an outboard motor with respect to a marine vessel, including copilot devices for locking the outboard motor in one several steering positions.

BACKGROUND

The following U.S. Patents are incorporated herein by reference, in entirety.

U.S. Pat. No. 5,582,527 discloses a steering device for an outboard motor that retains the motor under constant, although adjustable, pressure to releasably hold it in a plurality of secured positions. Moreover, the releasable restraining device permits rotation of the motor about the tilt and trim axis while the retaining device is in any of a plurality of retained positions.

U.S. Pat. No. 6,146,221 discloses an outboard motor having a steering lock which retains the rotational orientation of the outboard motor relative to a watercraft. The steering lock allows the motor to be pivoted about a substantially horizontal tilt and trim axis while the steering lock is engaged. The steering lock includes a friction plate which is advantageously straight. The friction plate is connected to the steering arm, and movement of either the steering arm or the friction plate requires movement of the other. At least one friction lock engages with the friction plate to secure the motor in a desired orientation. The friction lock is rigidly affixed to the outboard motor. The friction lock includes one or more disc pads. Movement of an operation lever urges the disc pads against the friction plate hold the friction plate and consequently, the steering arm, in a predetermined position.

U.S. Pat. No. 6,174,211 discloses an outboard motor having a tiller lock which retains the rotational orientation of the outboard motor relative to a watercraft. The tiller lock allows the motor to be pivoted about a substantially horizontal tilt and trim axis while the tiller lock is engaged. The tiller lock includes a friction track advantageously arranged rearward of the tilt and trim axis. The positioning of the friction track protects it from damage due to inadvertent contact with other components of the outboard motor mounting assembly. In particular, the friction track is protected throughout a full range of motion of the outboard motor. In addition, a pair of opposing brake members are alternately engageable with the friction track to secure the motor in a desired orientation. A bi-directional actuator handle urges either of the brake members into the friction plate independent of the other brake member to create a locking drag force which accompanies a substantially normal compressive force.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,969,475 discloses a system for mounting an outboard motor propulsion unit to a marine vessel transom includes a support cradle having a head section coupled to a transom bracket and a pair of arms extending aftward from the head section and along opposite port and starboard sides of the propulsion unit. A pair of upper mounts is provided, each upper mount in the pair coupling a respective arm to the propulsion unit aft of a center of gravity of an engine system of the propulsion unit. A pair of lower mounts is also provided, each lower mount in the pair coupling the propulsion unit to the transom bracket. The pair of upper mounts is located aft of the pair of lower mounts when the propulsion unit is in a neutral position, in which the propulsion unit is generally vertically upright and not tilted or trimmed with respect to the transom.

U.S. Pat. No. 10,124,871 discloses an outboard motor having a mounting assembly, a powerhead, a transmission, and a shift shaft that extends from the powerhead to the transmission via a conduit in the mounting assembly. The shift shaft is positionable into a forward position in which the transmission is engaged in forward gear, reverse position in which the transmission is engaged in reverse gear, and a neutral position in which the transmission is in neutral gear. In the forward position, an upper end of the shift shaft is positioned closer to a forward side of the conduit than the aftward side of the conduit. In the reverse position, the upper end of the shift shaft is positioned closer to an aftward side of the conduit than the forward side of the conduit. In the neutral position, the upper end of the shift shaft is positioned between the forward and reverse positions.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In examples disclosed herein, an apparatus is for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

BRIEF DESCRIPTION OF THE DRAWINGS

Examples are described with reference to the following drawing figures. The same numbers are used throughout to reference like features and components.

DETAILED DESCRIPTION

Figure 1:
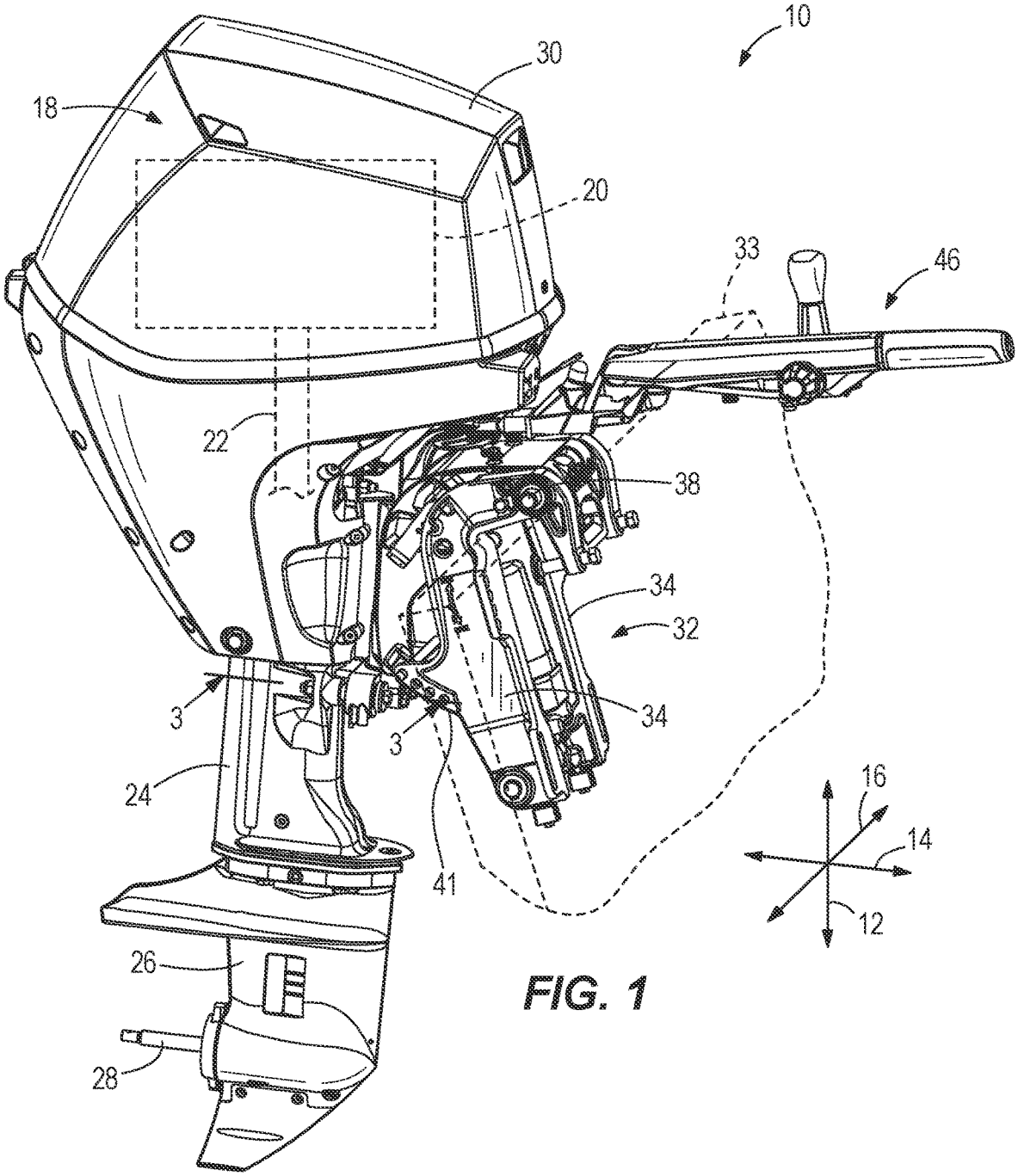
FIG. 1 is a starboard-side perspective view of an outboard motor.
Figure 2:
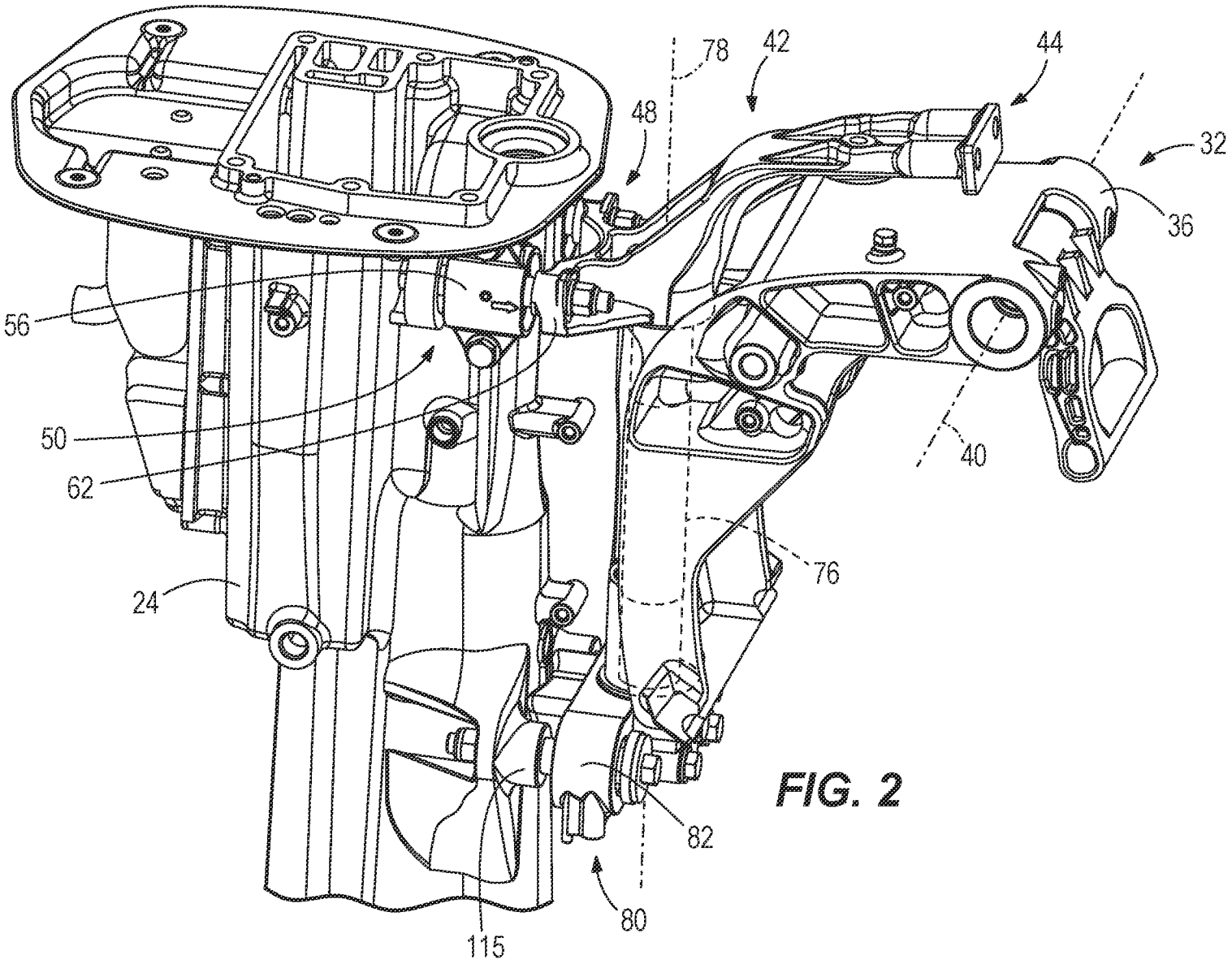
FIG. 2 is a starboard-side view of a driveshaft housing, steering arm, steering tube, and swivel bracket of a transom bracket.

FIGS. 1 and 2 depict an outboard motor 10. The outboard motor 10 extends from top to bottom in an axial direction 12, from fore to aft in a longitudinal direction 14 which is perpendicular to the axial direction 12, and from port to starboard in a lateral direction 16 which is perpendicular to the axial direction 12 and perpendicular to the longitudinal direction 14. The outboard motor 10 includes a powerhead 18, which among other things can include a conventional internal combustion engine 20 configured to cause rotation of an axially-elongated driveshaft 22 that extends axially downwardly from the internal combustion engine 20 into a driveshaft housing 24 located below the powerhead 18. A lower gearcase 26 is located below the driveshaft housing 24 and contains conventional bevel gears (not shown), which couple the axially-elongated driveshaft 22 to a longitudinally-elongated propeller shaft 28, such that rotation of the driveshaft 22 causes rotation of the propeller shaft 28. One or more propellers (not shown) are mountable on the propeller shaft 28 and configured to rotate with the propeller shaft 28 to thereby propel a marine vessel in water, all as is conventional. A top cowl 30 is mounted on top of the driveshaft housing 24 and encloses the powerhead 18.

A transom bracket 32 mounts the outboard motor 10 to the transom 33 of the marine vessel. The type and configuration of the transom bracket 32 can vary from what is shown. In the illustrated example, the transom bracket 32 includes a pair of clamp brackets 34 and a swivel bracket 36 located between the clamp brackets 34. The clamp brackets 34 are fixedly coupled to the transom 33, as shown. The swivel bracket 36 is pivotable with respect to the clamp brackets 34 about a pivot shaft 38 that laterally extends through the forward upper ends of the clamp brackets 34, particularly along a trim axis 40. A selector bracket having holes 41 is provided on at least one of the clamp brackets 34. Holes 41 respectively become aligned with a corresponding mounting hole on the swivel bracket 36 at different selectable trim positions for the outboard motor 10. A selector pin (not shown) can be manually inserted into the aligned holes to thereby lock the outboard motor 10 in place with respect to the trim axis 40, all as is conventional.

Figure 4:
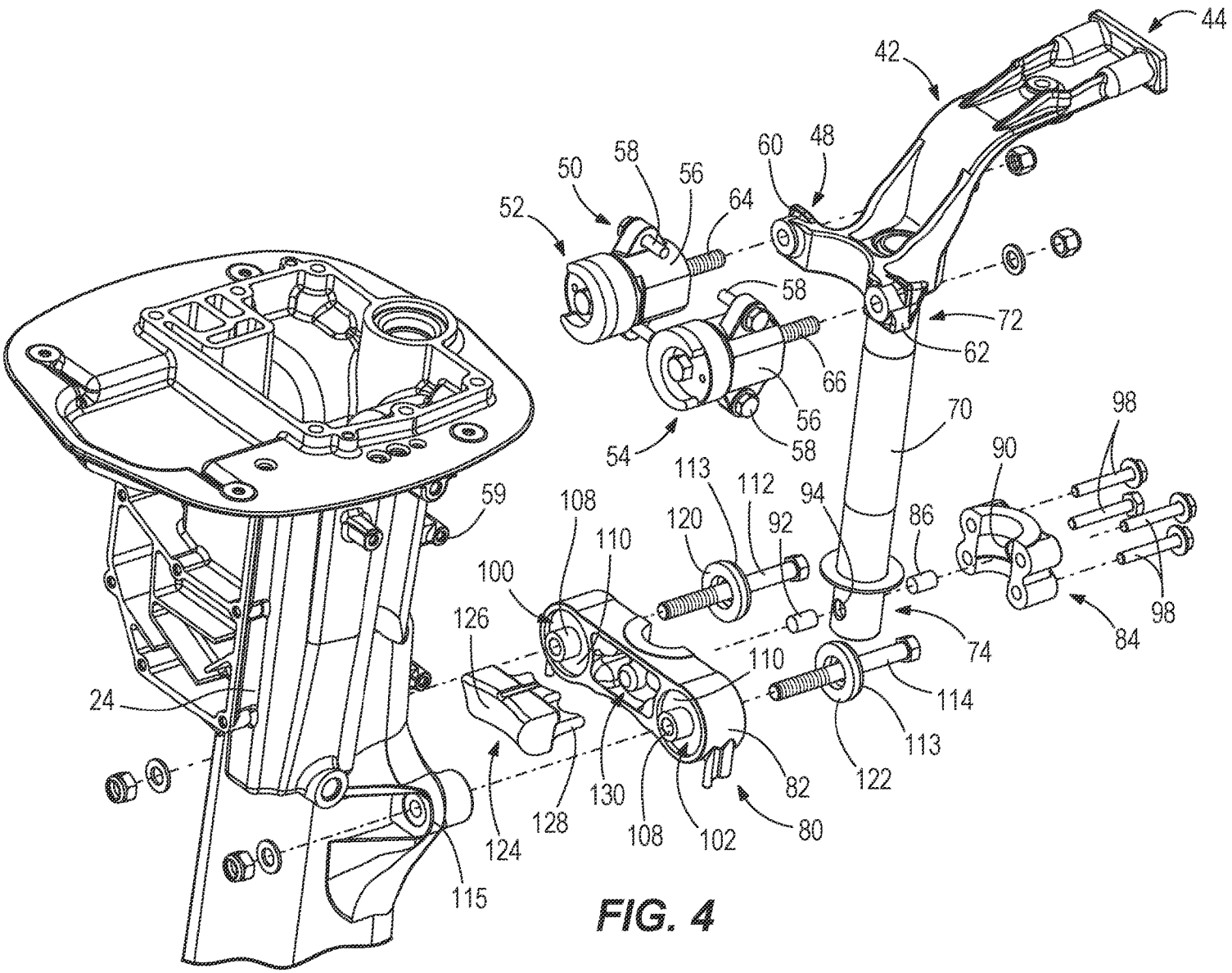
FIG. 4 is a port-side exploded view of components shown in FIG. 2.

Referring to FIGS. 2 and 4, the driveshaft housing 24 is coupled to the swivel bracket 36 such that pivoting of the swivel bracket 36 about the trim axis 40 trims the driveshaft housing 24 and the rest of the outboard motor 10 relative to the marine vessel, for example out of and/or back into the body of water in which the marine vessel is operated. In particular, a steering arm 42 is coupled to and extends forwardly from the driveshaft housing 24, towards the transom 33 of the marine vessel. The steering arm 42 has a forward end 44 that is rigidly connected to a manually operable tiller 46 (see FIG. 1) in a conventional arrangement. The tiller 46 is a conventional item, and the type and configuration of the tiller 46 can vary from what is shown. One example of a suitable tiller 46 is disclosed in the above-incorporated U.S. Pat. No. 9,764,813. Other suitable examples are disclosed in U.S. Pat. Nos. 10,246,173; 9,789,945; and 9,783,278; which are also incorporated herein by reference. Note however that many of the concepts of the present disclosure are not limited for use with tiller arms, and in fact could be implemented in marine drives having automatic steering systems or any other known apparatus for steering a marine drive with respect to a marine vessel.

The steering arm 42 has an opposite, aftward end 48 that is resiliently coupled to the driveshaft housing 24 by an upper mounting device 50. The type and configuration of the upper mounting device 50 can vary from what is shown. In the illustrated example, the upper mounting device 50 includes port and starboard mounts 52, 54 that each include a generally cylindrical housing 56, a radially inner cylindrical bearing (not shown), and a resilient elastomer element (not shown) disposed radially between the cylindrical housing 56 and the inner cylindrical bearing. The port and starboard mounts 52, 54 are conventional items, examples of which are disclosed in the above-incorporated U.S. Pat. Nos. 9,963,213; 9,701,383; and 9,205,906. The port and starboard mounts 52, 54 are coupled to port and starboard mounting flanges 60, 62 that laterally extend from the aftward end 48 of the steering arm 42. Port and starboard fasteners 64, 66 longitudinally extend through the port and starboard mounting flanges 60, 62 and through the inner cylindrical bearings. Fasteners 58 laterally extend through the mounting flanges on the cylindrical housing 56 and into corresponding laterally-extending mounting bosses 59 on the port and starboard sides of the driveshaft housing 24, thereby resiliently coupling the aftward end 48 of the steering arm 42 to the outboard motor 10.

Referring to FIGS. 2 and 4, a steering tube 70 is fixed to and extends downwardly from the steering arm 42. The steering tube 70 has a top end 72 that is rigidly fixed to the steering arm 42 and an opposite, bottom end 74. The steering tube 70 extends downwardly through a corresponding through-bore 76 in the swivel bracket 36 and is freely rotatable within the through-bore 76 and with respect to the swivel bracket 36. The steering tube 70 thus defines a steering axis 78 about which the outboard motor 10 can be steered, for example via manual operation of the tiller 46, as will be further described herein below.

Figure 3:
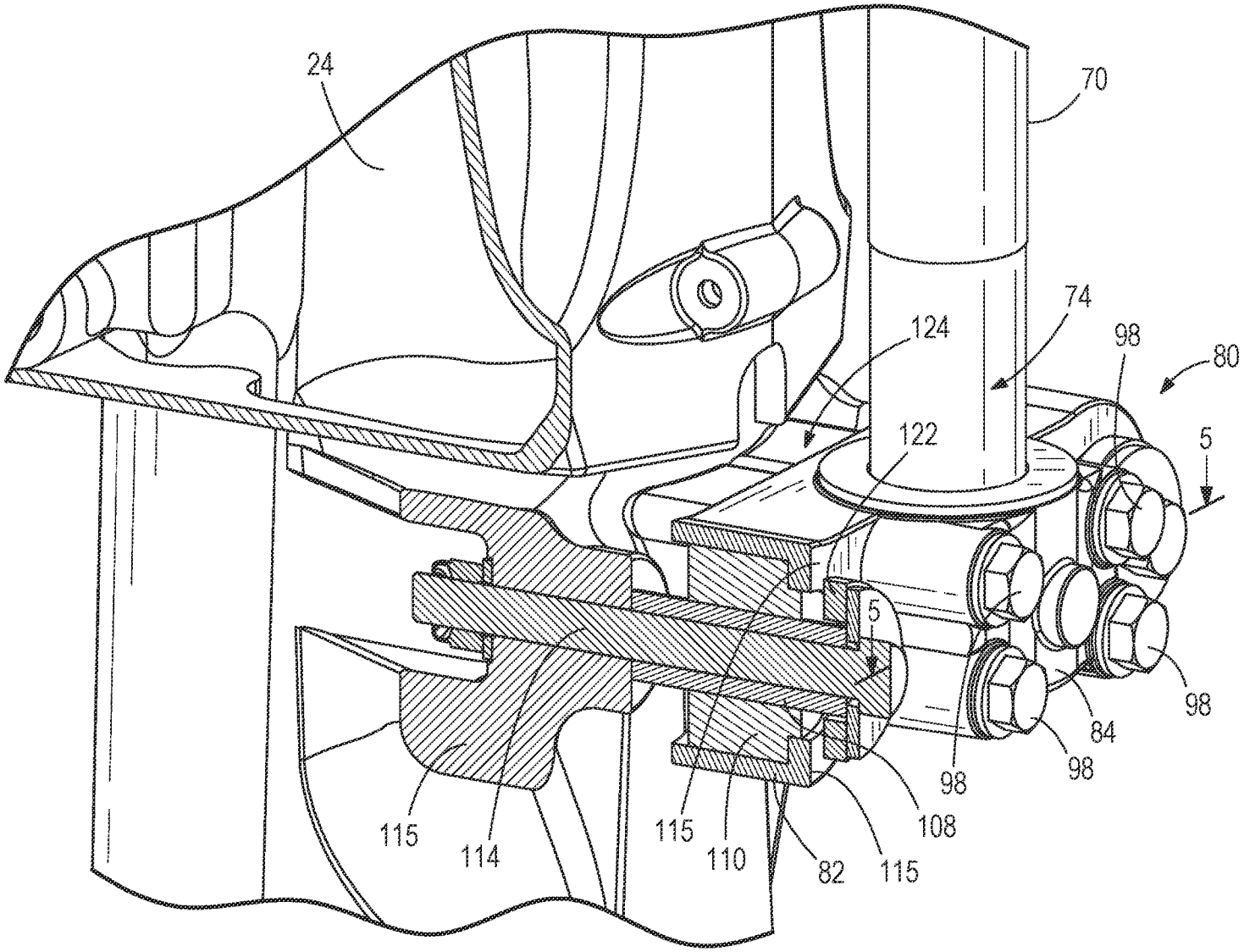
FIG. 3 is a view of section 3-3, taken in FIG. 1.
Figure 5:
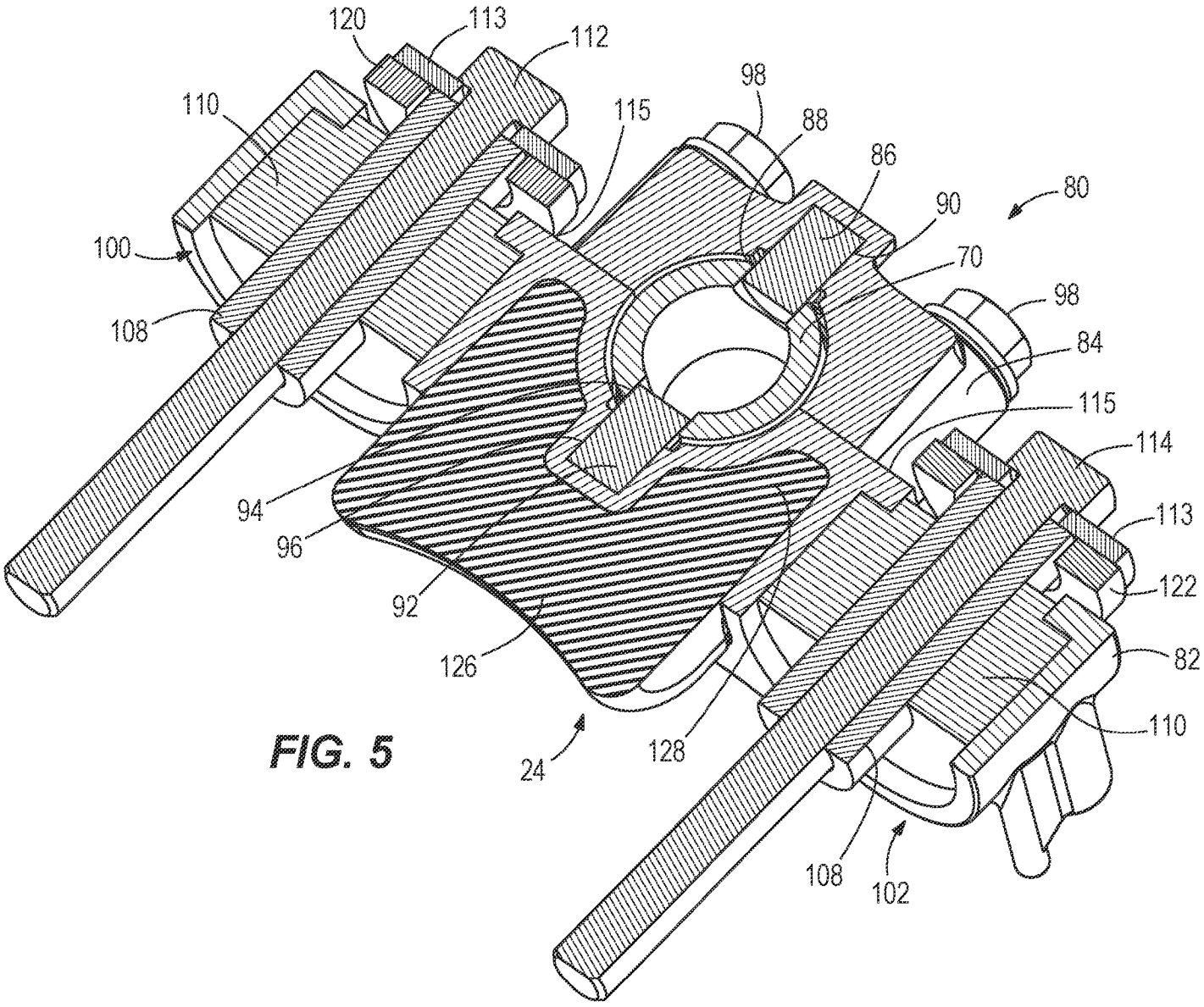
FIG. 5 is a view of section 5-5, taken in FIG. 3.

Referring to FIGS. 3-5, a lower mounting device 80 resiliently couples the bottom end 74 of the steering tube 70 to the driveshaft housing 24 in an easily serviceable arrangement that efficiently and effectively dampens vibrations between the outboard motor 10 and tiller 46. The lower mounting device 80 is located closer to the bottom end 74 of the steering tube 70 than the top end 72 and includes a yoke 82 that is clamped to the steering tube 70 by a clamping bracket 84. The yoke 82 is located longitudinally between the steering tube 70 and the driveshaft housing 24, and laterally extends from the steering tube 70. A first dowel pin 86 longitudinally extends through a hole 88 in the bottom end 74 of the steering tube 70 and a corresponding hole 90 in the clamping bracket 84 to thereby rotationally lock the clamping bracket 84 with respect to the steering tube 70. A second dowel pin 92 longitudinally extends through a radially opposite hole 94 in the bottom end 74 of the steering tube 70 and a corresponding hole 96 in the yoke 82 to thereby rotationally lock the yoke 82 with respect to the steering tube 70. Four fasteners 98 longitudinally extend through corresponding holes in the clamping bracket 84 and holes in the yoke 82. Tightening the fasteners 98 effectively clamps the clamping bracket 84 and yoke 82 together, sandwiching the steering tube 70 there between. Thus, the lower mounting device 80 is securely clamped onto the bottom end 74 of the steering tube 70. Removal of the fasteners 98 advantageously allows a technician to service and/or replace the lower mounting device 80 without requiring disassembly of the surrounding components, such as the steering tube 70.

The yoke 82 contains port and starboard mounts 100, 102 that resiliently couple the steering tube 70 to the driveshaft housing 24. In particular, the yoke 82 has a port through-bore 104 in which the port mount 100 is located and a starboard through-bore 106 in which the starboard mount 102 is located. Each of the port and starboard mounts 100, 102 has a longitudinally-extending, radially inner cylindrical bearing 108 and a resilient (e.g., elastomer) element 110 disposed radially between the inner cylindrical bearing 108 and respective through-bore 104, 106. Preferably, the resilient (e.g., elastomer) element 110 of the port and starboard mounts 100, 102 is adhered (bonded) to the radially inner surfaces 111 of the port and starboard through-bores 104, 106 for example by an adhesive. Port and starboard fasteners 112, 114 longitudinally extend through the inner cylindrical bearings 108 of the port and starboard mounts 100, 102 and into corresponding longitudinally-oriented port and starboard mounting flanges 116, 118 on the driveshaft housing 24. Resilient (e.g., elastomer) washers 120, 122 are located on the port and starboard fasteners 112, 114 and are clamped (sandwiched) between metal washers 113 and the heads of the respective fasteners 112, 114, and forward outer surface flanges 115 on the yoke 82.

Figure 6:
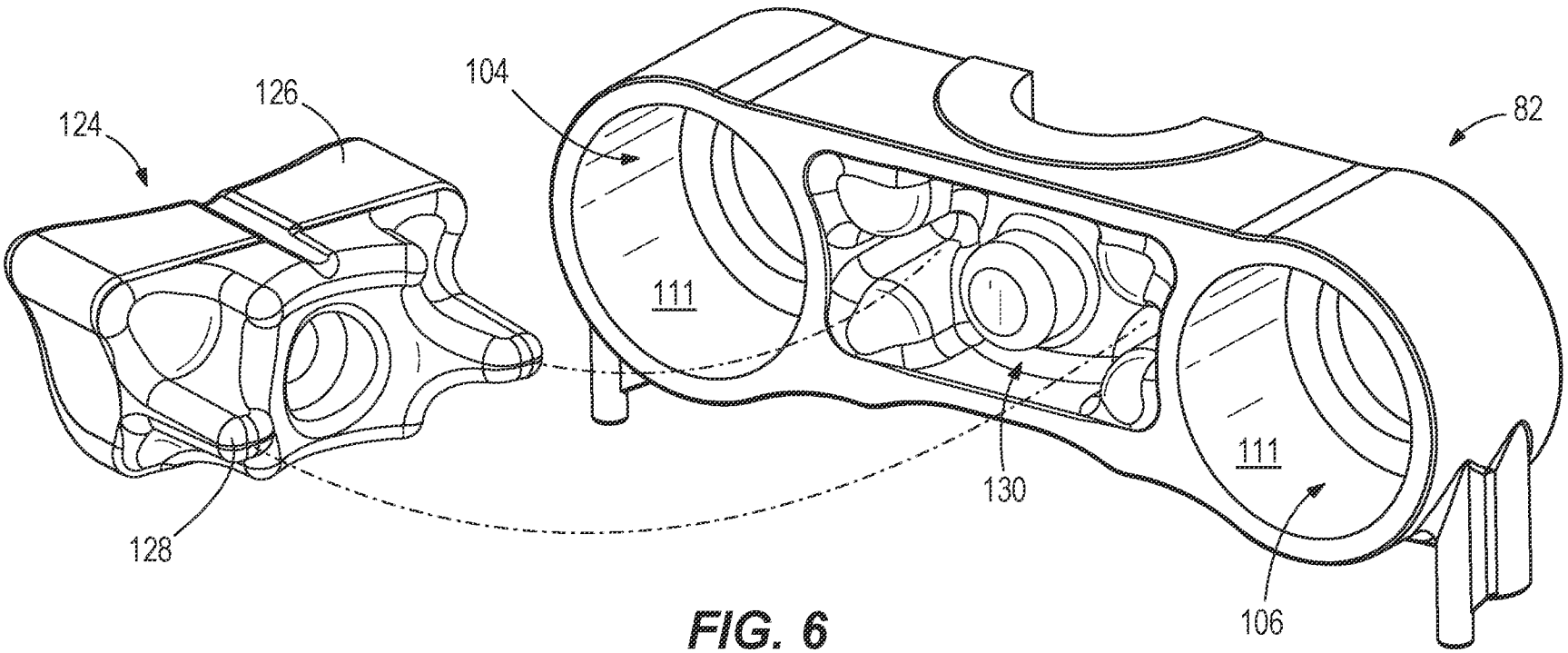
FIG. 6 is an exploded view of components shown in FIG. 5.

Referring to FIGS. 5 and 6, an elastomer, resilient bumper 124 is mounted onto the yoke 82, laterally between the port and starboard mounts 100, 102. The resilient bumper 124 has a body 126 and a tongue 128 that longitudinally extends into engagement with a corresponding recess 130 in the yoke 82. Referring to FIG. 2, the body 126 of the bumper 124 faces and at times abuts the forward exterior surface of the driveshaft housing 24, thus cushioning relative movements between the steering tube 70 and the driveshaft housing 24, protecting these components from collision and thus damage.

In use, the outboard motor 10 is steered via the tiller 46, steering arm 42 and steering tube 70. In particular, an operator of the marine vessel manually grasps and pivots the tiller 46 in either of the port or starboard directions. Pivoting of the tiller 46 pivots the forward end 44 of the rigidly connected steering arm 42, which in turn rotates the steering tube 70 within the through-bore 76 in the swivel bracket 36. Pivoting of the forward end 44 of the steering arm 42 causes commensurate pivoting of the aftward end 48 of the steering arm 42, which is resiliently coupled to the driveshaft housing 24 via the upper mounting device 50. Pivoting of the steering arm 42 also causes rotation of the steering tube 70, which is resiliently coupled at its bottom end 74 to the driveshaft housing 24 via the lower mounting device 80. Thus pivoting of the steering arm 42 causes steering movement of the outboard motor 10 about the steering axis 78, including the powerhead 18, driveshaft housing 24, lower gearcase 26, etc.

Advantageously, the resilient port and starboard mounts 52, 54 and the resilient port and starboard mounts 100, 102 dampen vibrations between the outboard motor 10 and transom 33, thus providing a smoother and more enjoyable operation by the captain. Through research and experimentation, the present inventors determined that the presently disclosed mounting apparatus, and particularly the above-described binocular configuration of the lower mounting device 80, being coupled to both the driveshaft housing 24 and clamped to the bottom end 74 of the steering tube 70 advantageously achieves desired engine vibration isolation and steering control. The present inventors conceived of the presently disclosed configuration, which accomplishes these objectives in a compact and easy to service package, without requiring, for example, removal of the steering tube 70 or other components of the outboard motor 10 from the transom bracket 32.

FIGS. 7-12 depict another example of the outboard motor 10 and transom bracket 32 configured to support the outboard motor 10 with respect to the above-noted marine vessel. As with the example shown in FIGS. 1-6, the configuration of the transom bracket 32 shown in FIGS. 7-12 can vary from what is shown. In the illustrated example, the transom bracket 32 has clamp brackets 34, which are configured for fixed attachment to the marine vessel. The transom bracket 32 further has a swivel bracket 36 located between the clam brackets 34 and being pivotable with respect to the clamp brackets 34 to thereby trim the outboard motor about the above-described trim axis 40. The example shown in FIGS. 7-12 is particularly configured for use with the manually operable tiller 46, which as described herein above can for example be configured in any one of a variety of conventional ways, suitable examples of which being disclosed in the presently-incorporated U.S. Pat. Nos. 10,246,173; 9,789,945; 9,764,813; and 9,783,278. A steering arm 42 is resiliently coupled to and extends forwardly from the driveshaft housing 24 of the outboard motor 10, towards the marine vessel. The steering arm 42 has a forward end 44 that is rigidly connected to the tiller 46 (see FIG. 9) in a conventional arrangement. The steering arm 42 has an opposite, aftward end 48 that is resiliently coupled to the driveshaft housing 24 by an upper mounting device, as described herein above with respect to FIGS. 1-6. A steering tube 70 extends downwardly from the steering arm 42. The steering tube 70 has a top end 72 that is rigidly fixed to the steering arm 42 and an opposite, bottom end 74. The steering tube 70 extends downwardly through a corresponding through-bore 76 in the swivel bracket 36 and is freely rotatable within the through-bore 76 and with respect to the swivel bracket 36. The steering tube 70 thus defines a steering axis 78 about which the outboard motor 10 can be steered, for example via manual operation of the tiller 46, as described herein above.

Figure 10:
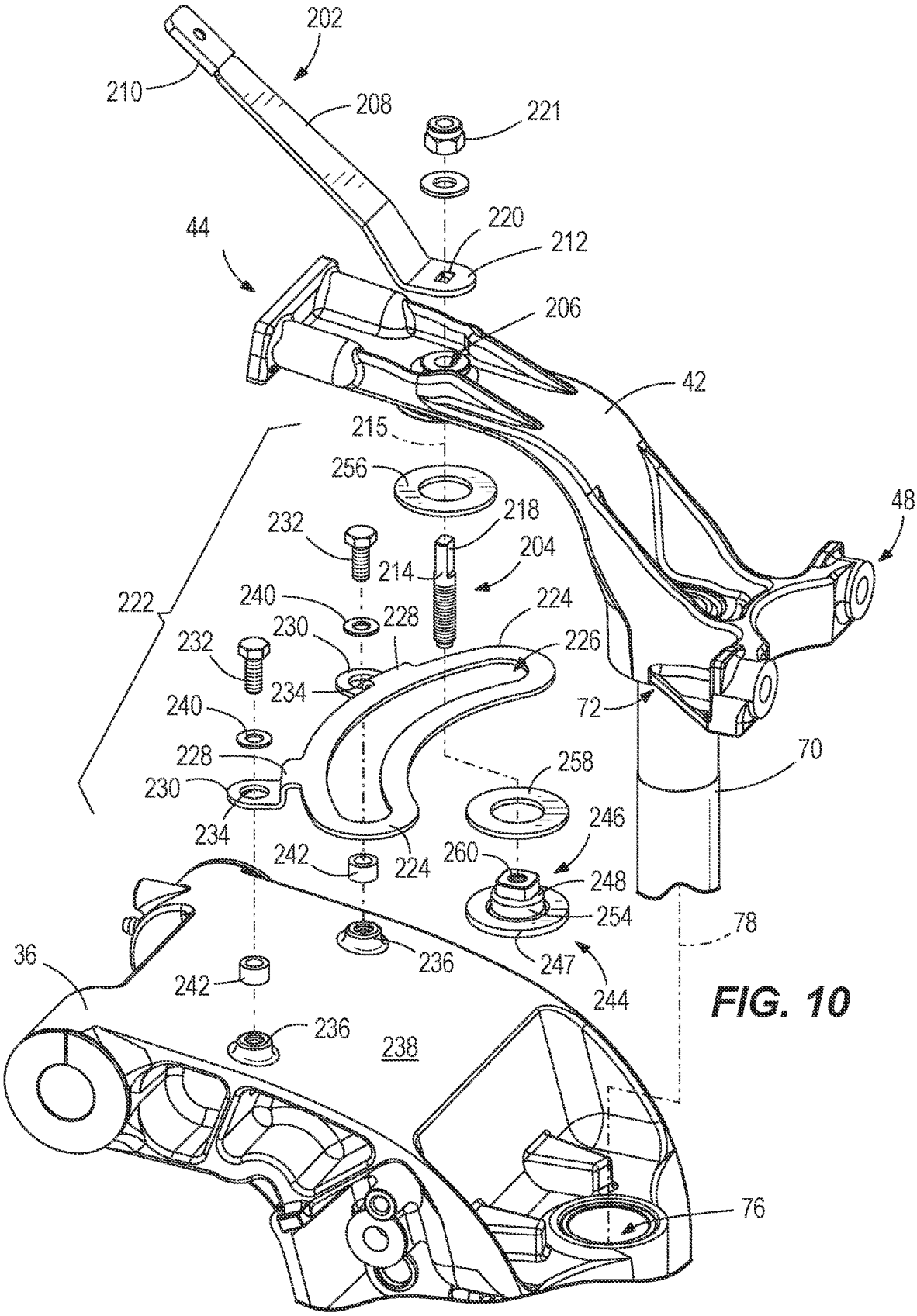
FIG. 10 is an exploded view of the swivel bracket portion of the transom bracket, steering arm, steering tube, and copilot device.

The embodiment shown in FIGS. 7-12 differs from the embodiment shown in FIGS. 1-6 in that it has a novel copilot device 200 which is configured according to the present disclosure, and which in particular is advantageously configured to facilitate manual locking of the outboard motor 10 in each of a plurality of steering positions relative to the steering axis 78. Referring to FIG. 10, the copilot device 200 includes an input device 202 extending above the steering arm 42 and being manually operable from above the steering arm 42. The copilot device 200 further includes an actuator member 204 that extends through a through-bore 206 which is generally centrally located between the forward end and aftward ends 44, 48 of the steering arm 42. In the illustrated example, the through-bore 206 is located closer to the forward end 44 than the aftward end 48, however this could vary from what is shown.

Referring to FIG. 10, in the illustrated example, the input device 202 includes a lever 208 having an outer end 210 that provides a handle for manual grasping by the operator and an inner end 212 that is engaged with the actuator member 204. In the illustrated example, the actuator member 204 is an actuator pin 214 having an upper end 216 with flats 218 that engage with corresponding inner surfaces of a hole 220 in the inner end 212 of the lever 208. A nut and bolt 221 fastens the components together. As such, rotation of the input device 202, as shown via dash-and-dot lines in FIG. 8, rotates the actuator pin 214 about its own axis 215.

Figure 12:
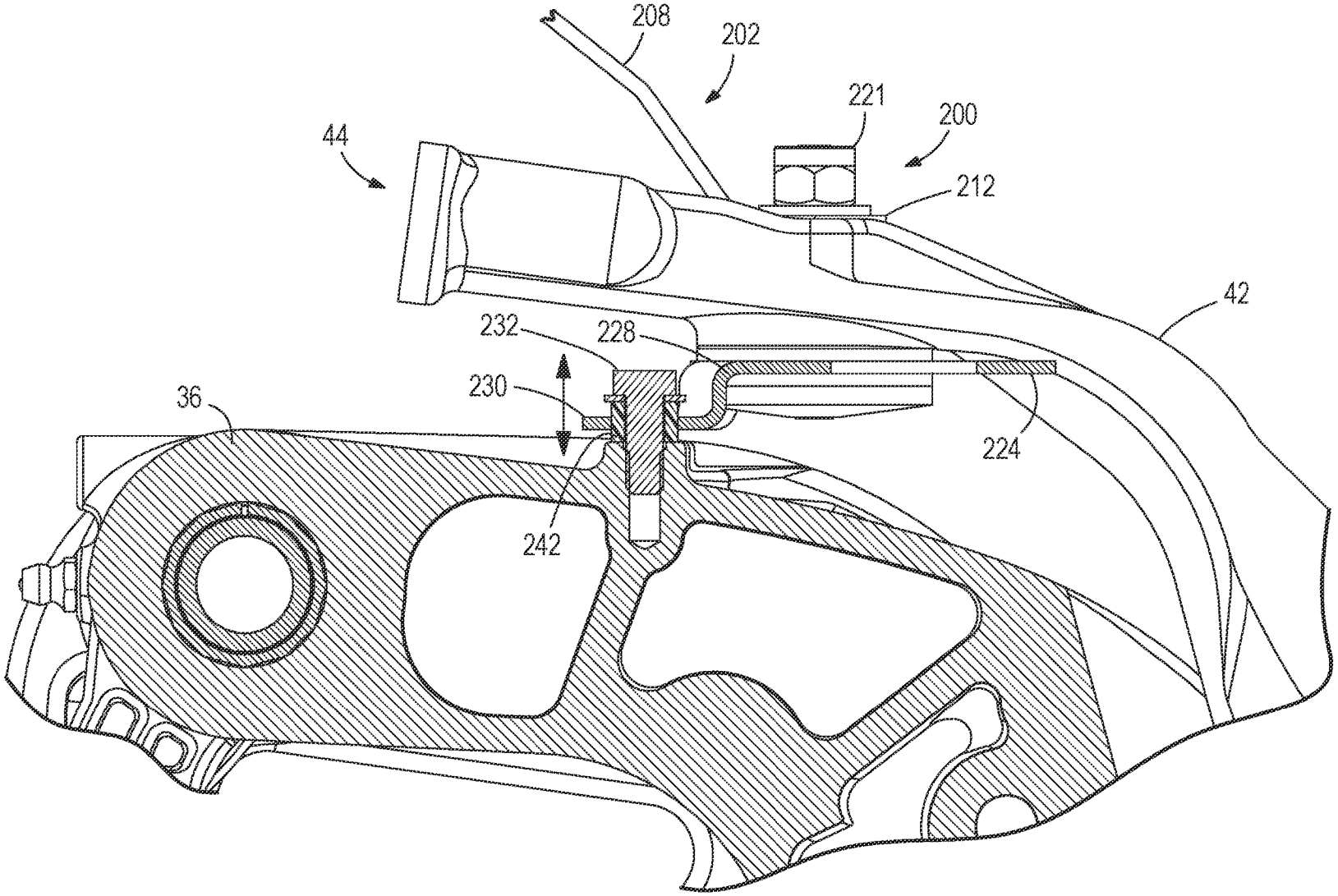
FIG. 12 is a view of section 12-12, taken in FIG. 9.

Referring to FIG. 10, the copilot device 200 further includes a brake mechanism 222 located between the steering arm 42 and the transom bracket 32. The brake mechanism 222 has a brake bracket 224 that is a generally curvilinear plate having an arc-shaped channel 226 defined therein. The brake bracket 224 is mounted on the swivel bracket 36. In particular, a pair of shoulders 228 extend downwardly and forwardly from the curvilinear plate to a pair of ears 230, which in turn extend forwardly from the pair of shoulders 228. Thus the pair of ears 230 are generally parallel to, but are positioned slightly lower than the curvilinear plate, via the shoulders 228. Fasteners 232 axially extend through holes 234 in the ears 230 into boreholes 236 to thereby fix the brake bracket 224 to the top surface 238 of the swivel bracket 36. Referring to FIGS. 10 and 12, each fastener 232 extends through a top washer 240, located on top of the respective ear 230 and through a bushing 242 located on top of the respective borehole 236. The bushing 242 is disposed in the respective hole 234 in the ear 230 and thus allows axial movement of the ear 230 (i.e., allows the ear to "float" along the bushing 242), as shown by the arrow in FIG. 12. This type of connection permits axial movement of the brake bracket 224 along the outer surface of the bushing 242, thus advantageously allowing for differences in size and shape of the relative components during mass production (referred to in the art as "manufacturing tolerances") and vertical movement under tiller handle deflections.

Figure 11:
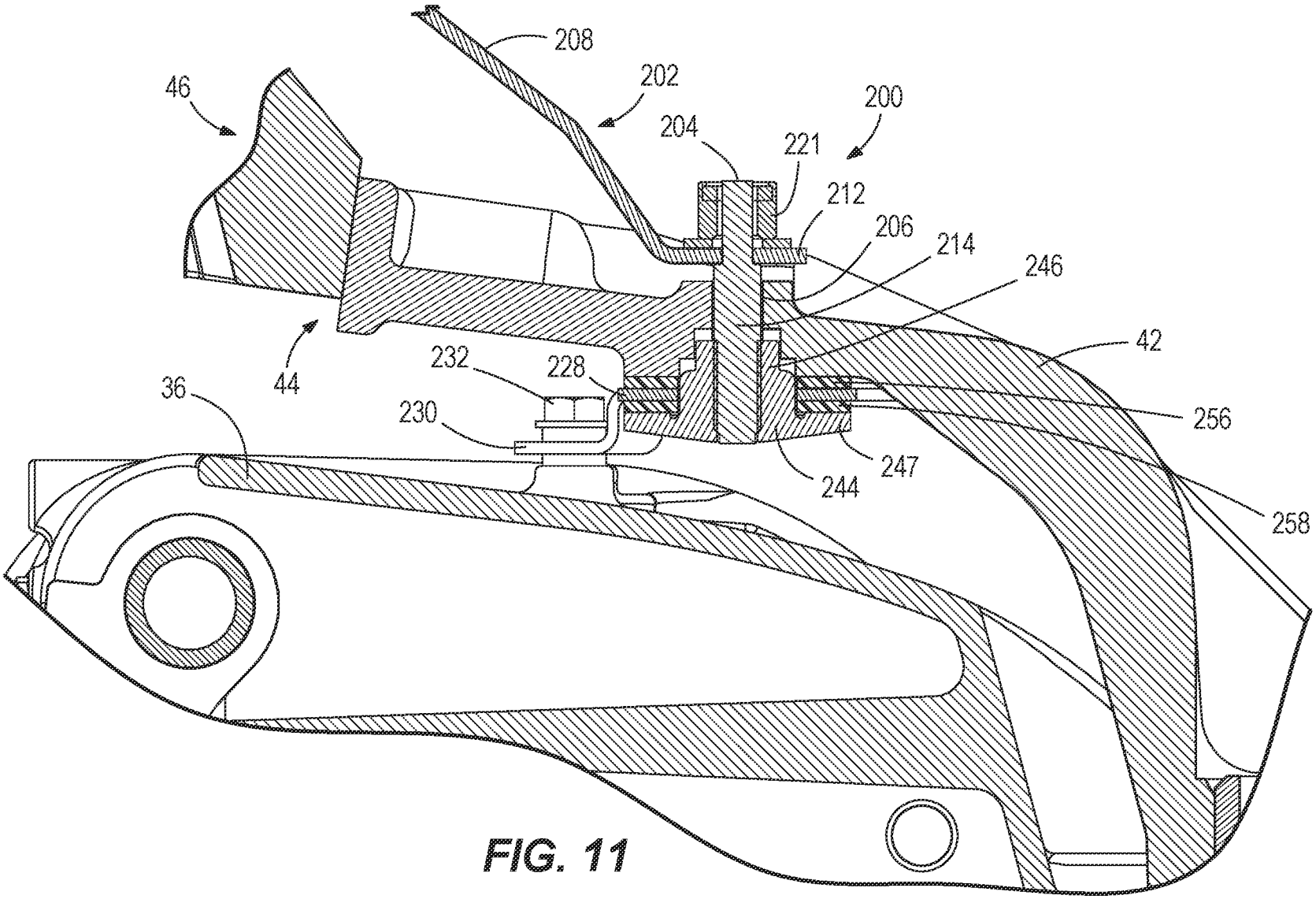
FIG. 11 is a view of section 11-11, taken in FIG. 9.

Referring to FIGS. 10 and 11, the brake mechanism 222 further includes a flanged bushing 244 having a stem 246 and a peripheral flange 247 that radially outwardly extends from the stem 246 and has a circular outer perimeter. The stem 246 extends into an enlarged lower portion of the through-bore 206 in the steering arm 42. The stem 246 has an axially outer end portion 248 having a non-circular perimeter surface, which in the illustrated example is a hex-shape having six flat surfaces. The enlarged lower portion of the through-bore 206 in the steering arm 42 has a non-circular inner perimeter surface with a corresponding hex-shape having six flat surfaces that align with the six flat surfaces on the stem 246. By providing non-circular shapes for the outer end portion 248 of the stem 246 and the enlarged lower portion of the through-bore, the stem 246 is rotationally locked with respect to the steering arm 42. It should be recognized that the particular non-circular shapes can vary, and for example could be oval or have any other suitable non-circular shape. The stem 246 further has an elongated axially inner end portion 254 located between the peripheral flange 247 and the outer end portion 248. The inner end portion 254 has a generally smooth outer surface, which in the illustrated example is cylindrical. As shown in FIGS. 10 and 12, the stem 246 is disposed in the arc-shaped channel 226 and such that the generally smooth outer surface of the inner end portion 254 slides along the length of the arc-shaped channel 226 the tiller 46, steering arm 42 and outboard motor 10 are steered about the steering axis 78 and relative to the swivel bracket 36.

Referring to FIG. 10, the actuator pin 214 is a threaded fastener that extends along the axis 215 into a correspondingly threaded bore 260 in the stem 246. Thus the actuator pin 214 is engaged with the threaded bore 260 via a threaded connection such that rotation of the input device 202 and actuator pin 214 in a first direction 262 (FIG. 8) causes the flanged bushing 244 to axially move towards (i.e., upwardly, further into engagement with) the actuator pin 214 and such that rotation of the input device 202 and actuator pin 214 in the opposite, second direction 264 (FIG. 8) causes the flanged bushing 244 to axially move away from (i.e., downwardly, further out of engagement with) the actuator pin 214. It will thus be seen that rotation of the input device 202 and actuator pin 214 in the first direction 262 moves the peripheral flange 247 towards the bottom of the brake bracket 224 and towards the lower surface of the steering arm 42 and that rotation of the input device 202 and actuator pin 214 in the second direction 264 moves the peripheral flange 247 away from the bottom of the brake bracket 224 and away from the lower surface of the steering arm 42.

The brake mechanism 222 further includes top and bottom brake pads 256, 258 disposed on the located on the axially inner end portion 254 of the stem 246, and on top and bottom sides of the brake bracket 224. As shown in FIG. 11, the brake bracket 224 thus becomes sandwiched between the brake pads 256, 258 when the actuator pin 214 is rotated in the first direction 262, which as further explained herein below, brakes the brake bracket 224 via the brake pads 256, 258 and locks (i.e. prevents movement of) the outboard motor with respect to the steering axis 78. In the illustrated example, the brake pads 256, 258 are metal washers; however the type and configuration of the brake pads 224 can vary from what is shown and can include any device and/or material for engaging with the brake bracket 224.

Figure 7:
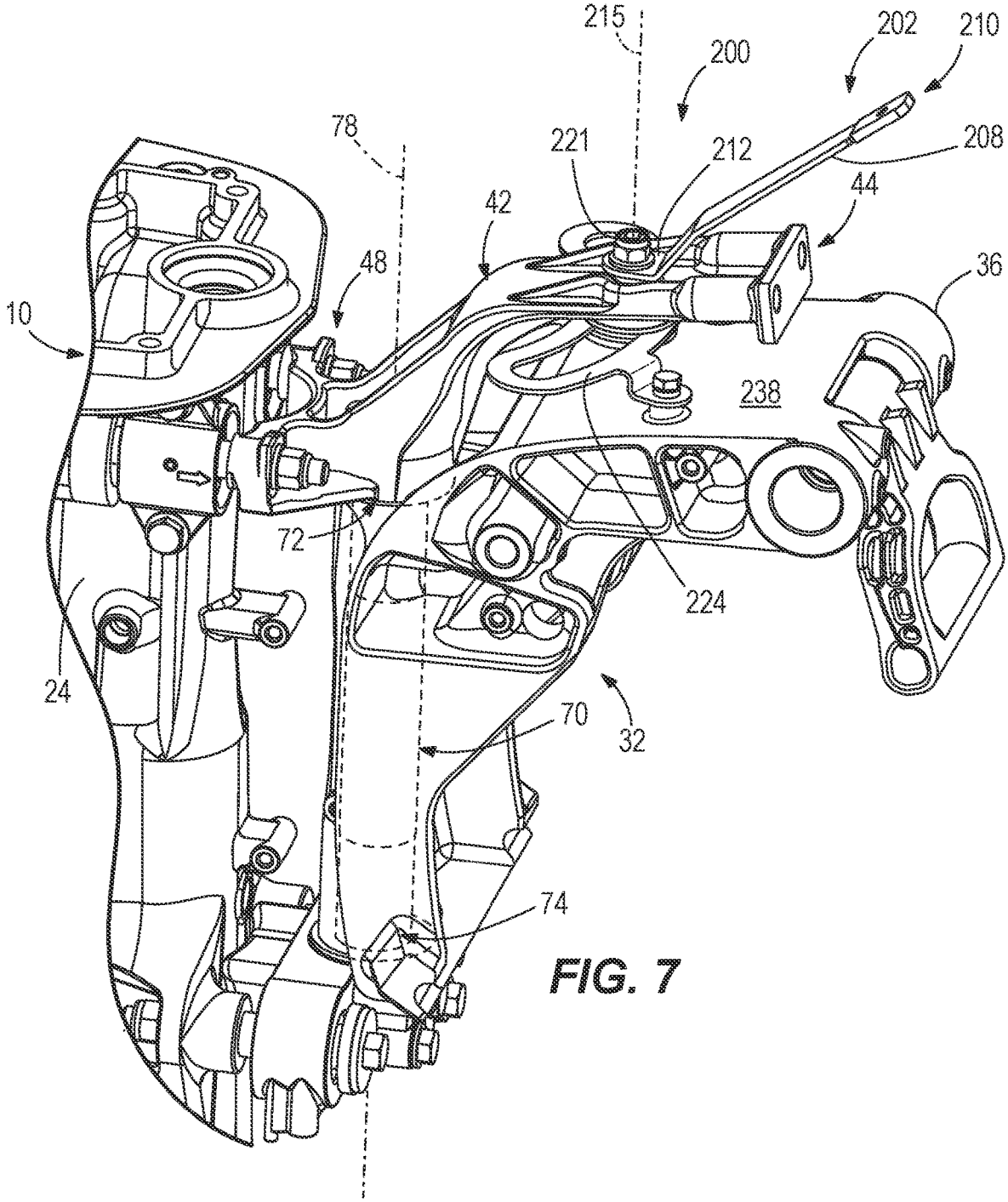
FIG. 7 is a side perspective view of another embodiment of the transom bracket and a copilot device according to the present disclosure.
Figure 8:
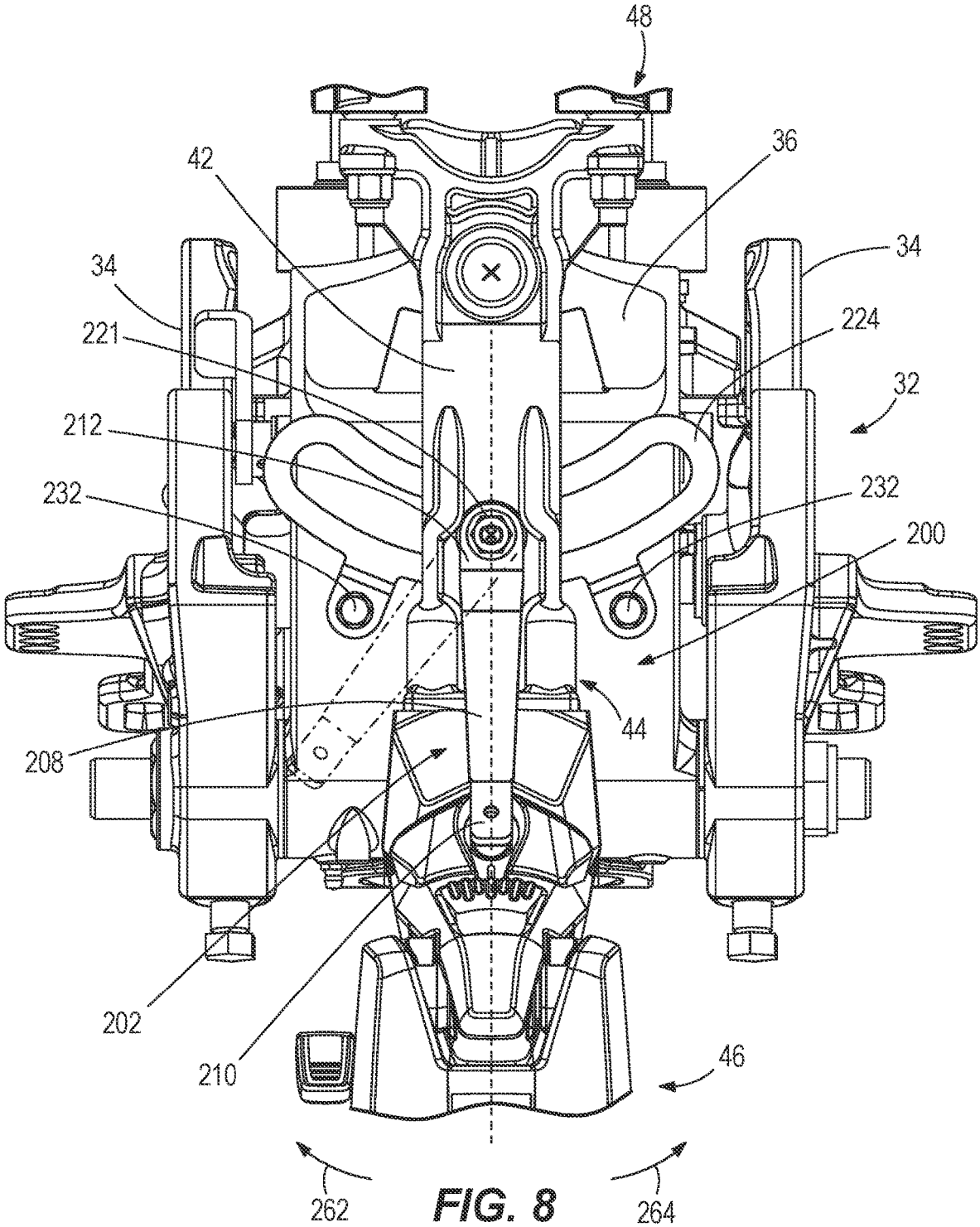
FIG. 8 is a top view of the transom bracket and copilot device.
Figure 9:
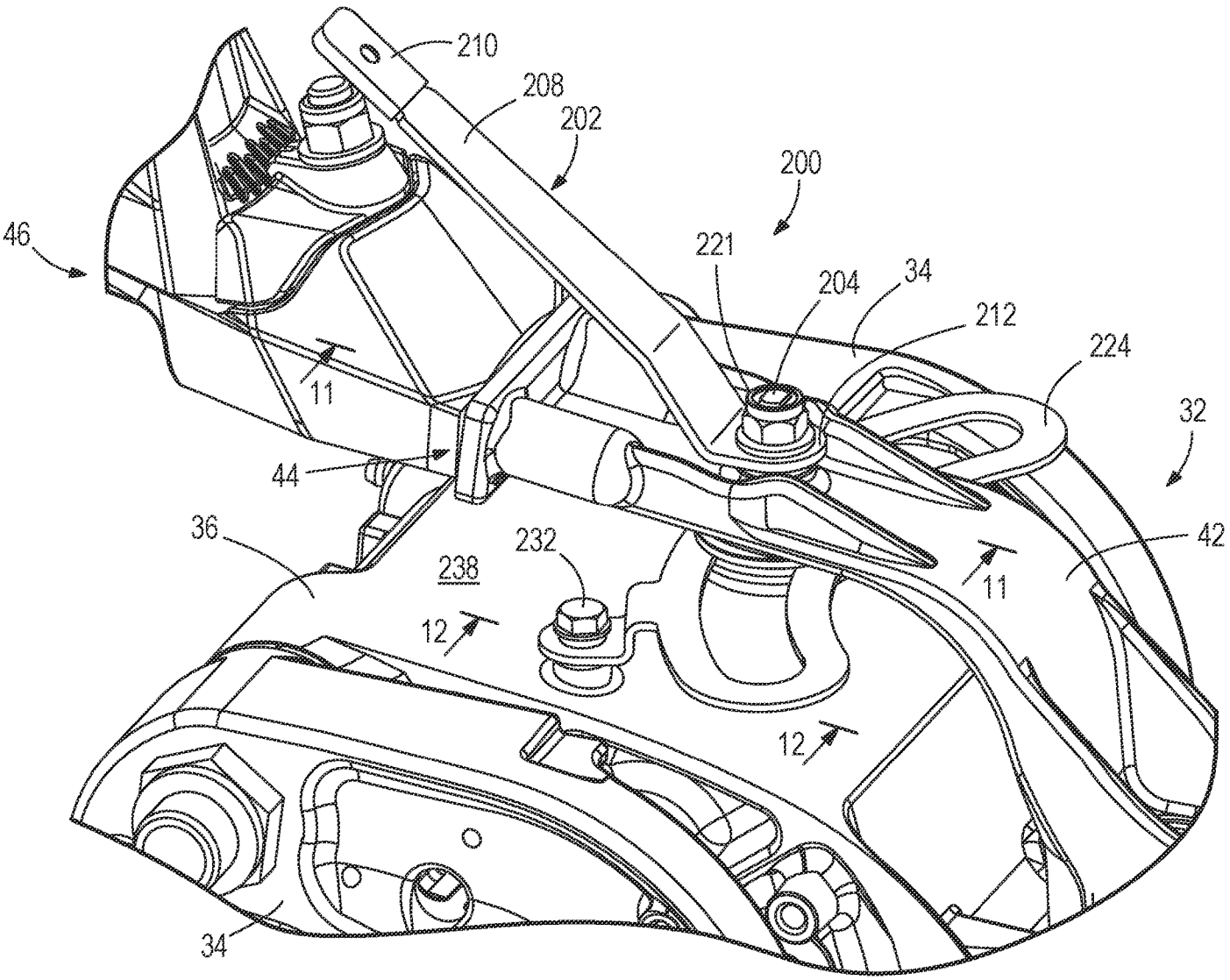
FIG. 9 is a closer, opposite side perspective view of the transom bracket, steering arm and copilot device.

Referring now to FIGS. 7 and 8, the copilot device 200 is advantageously manually operable from above the steering arm 42 relative to the axial direction 12. In use, when the operator desires to rotationally lock the outboard motor 10 in a steering position, the operator engages the input device 202 by manually grasping the outer handle end 210 of the lever 208. The operator rotates the lever 208 in the first direction 262, which thereby rotates the actuator pin 214 in the first direction 262. As described herein above, rotation of the actuator pin 214 in the first direction 262 causes the flanged bushing 244 to axially travel upwardly, further onto the threaded portion of the actuator pin 214. This causes the stem 246 to axially travel into the enlarged lower portion of the through-bore 206. The non-circular outer and inner perimeter surfaces of the axially outer end portion 252 of the stem 246 and enlarged lower portion of the through-bore 206 prevent rotation of the flanged bushing 244 about the axis 215, thus enacting the axial travel of the flanged bushing 244 along the actuator pin 214. Continue rotation of the lever 208 in the first direction 262 engages the peripheral flange 247 and lower brake pad 258 with the bottom of the brake bracket 224 and engages the top of the brake bracket 224 with the upper brake pad 256 and the bottom of the steering arm 42. This forcibly sandwiches the brake bracket 224, which is fixed to the swivel bracket 36, thus rotationally locking the steering arm 42 to the swivel bracket 36 and locking the outboard motor 10, which is fixed to the steering arm 42 via the above-described upper mounting device.

When the operator desires to rotationally unlock the steering position of the outboard motor 10, the operator grasps the outer handle end 210 of the lever 208 and rotates it in the second direction 264. As described herein above, rotation of the input device 202 and actuator pin 214 in the second direction 264 causes the flanged bushing 244 to axially travel downwardly, further out of engagement with the threaded fastener. This causes the stem 246 to axially travel outwardly relative to the enlarged lower portion of the through-bore 206, and unclamps and/or reduces friction of the upper and lower brake pads 256, 258 from the brake bracket 224, thus permitting subsequent steering motion of the tiller 46, steering arm 42 and outboard motor 10 in the first and second directions 262, 264 about the steering axis 78 and relative to the swivel bracket 36.

It will thus be seen that the present disclosure provides a novel copilot device configured so as to be easily accessible and manually operable from above the steering arm, without having to reach around or otherwise beneath the tiller and steering arm. The copilot device has conveniently-located input device that is movable into a locked position in which the outboard motor is locked in one of the plurality of steering positions and an unlocked position in which the outboard motor is steerable relative to the steering axis. That is, movement of the input device into the locked position causes the brake mechanism to lock the outboard motor in the one of the plurality of steering positions and wherein movement of the input device into the unlocked position causes the brake mechanism to unlock the outboard motor with respect to the steering axis. Movement of the input device into the locked position rotates the actuator pin in a first direction, which thereby clamps the flanged bushing onto the brake bracket, and movement of the input device into the unlocked position rotates the actuator pin in an opposite, second direction, which thereby unclamps the flanged bushing from the brake bracket. Moving the input device into the locked position sandwiches the brake pads and the brake bracket between the flanged bushing and a lower surface of the steering arm. The particular configuration shown allows for variable friction to be applied and for the apparatus to be placed in states between the fully locked and unlocked states. This aids the person steering by reducing prop torque transmitted to the person steering the boat.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An apparatus for steering an outboard motor with respect to a marine vessel, the apparatus comprising a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis; and a copilot device configured to lock the outboard motor in each of a plurality of steering positions relative to the steering axis, wherein the copilot device extends above and is manually operable from above the steering arm, wherein the brake mechanism comprises a brake bracket mounted on the transom bracket and a flanged bushing that clamps and alternately unclamps onto the brake bracket so as to lock and unlock the outboard motor with respect to the steering axis.

2. The apparatus according to claim 1, wherein the copilot device comprises an input device located above the steering arm, the input device being movable into a locked position in which the outboard motor is locked in one of the plurality of steering positions and an unlocked position in which the outboard motor is steerable relative to the steering axis.

3. The apparatus according to claim 2, wherein the input device comprises a lever.

4. The apparatus according to claim 2, wherein the input device further comprises an actuator member that extends through the steering arm.

5. The apparatus according to claim 4, wherein the copilot device further comprises a brake mechanism located between the steering arm and the transom bracket, wherein movement of the input device into the locked position causes the brake mechanism to lock the outboard motor in the one of the plurality of steering positions and wherein movement of the input device into the unlocked position causes the brake mechanism to unlock the outboard motor with respect to the steering axis.

6. An apparatus for steering an outboard motor with respect to a marine vessel, the apparatus comprising:

a transom bracket configured to support the outboard motor with respect to the marine vessel; a tiller for manually steering the outboard motor with respect to a steering axis;

a steering arm extending above the transom bracket and coupling the tiller to the outboard motor such that rotation of the tiller causes rotation of the outboard motor with respect to the steering axis; and a copilot device configured to lock the outboard motor in each of a plurality of steering positions relative to the steering axis, wherein the copilot device extends above and is manually operable from above the steering arm;

wherein the copilot device comprises an input device located above the steering arm, the input device being movable into a locked position in which the outboard motor is locked in one of the plurality of steering positions and an unlocked position in which the outboard motor is steerable relative to the steering axis;

wherein the input device further comprises an actuator member that extends through the steering arm; wherein the copilot device further comprises a brake mechanism located between the steering arm and the transom bracket;

wherein movement of the input device into the locked position causes the brake mechanism to lock the outboard motor in the one of the plurality of steering positions and wherein movement of the input device into the unlocked position causes the brake mechanism to unlock the outboard motor with respect to the steering axis; and wherein the brake mechanism comprises a brake bracket mounted on the transom bracket and a flanged bushing that clamps and alternately unclamps onto the brake bracket so as to lock and unlock the outboard motor with respect to the steering axis.

7. The apparatus according to claim 6, wherein the transom bracket comprises a clamp bracket configured for fixed attachment to the marine vessel and a swivel bracket that is pivotable with respect to the clamp bracket to thereby trim the outboard motor, and wherein the brake bracket is mounted on the swivel bracket.

8. The apparatus according to claim 6, wherein the actuator comprises an actuator pin, wherein movement of the input device into the locked position rotates the actuator pin in a first direction, which thereby clamps the flanged bushing onto the brake bracket, and wherein movement of the input device into the unlocked position rotates the actuator pin in an opposite, second direction, which thereby unclamps the flanged bushing from the brake bracket.

9. The apparatus according to claim 8, wherein the actuator pin comprises a threaded fastener that extends along an axis, and wherein the flanged bushing comprises a threaded bore in which the threaded fastener is engaged such that rotation of the actuator pin in the first direction causes the flanged bushing to move axially towards the actuator pin and such that rotation of the actuator pin in the second direction causes the flanged bushing to move axially away from the actuator pin.

10. The apparatus according to claim 8, wherein the brake mechanism further comprises brake pads located on opposite sides of the brake bracket, wherein moving the input device into the locked position sandwiches the brake pads and the brake bracket between the flanged bushing and a lower surface of the steering arm.

11. The apparatus according to claim 8, wherein the flanged bushing comprises a stem that extends into the steering arm and is rotationally locked with respect to the steering arm.

12. The apparatus according to claim 11, wherein the stem comprises an outer end portion with a non-circular outer perimeter surface that is disposed in a corresponding non-circular inner perimeter surface of a through-bore in the steering arm.

13. The apparatus according to claim 8, wherein the bushing comprises a stem and a peripheral flange that radially outwardly extends from the stem, and wherein rotation of the actuator pin in the first direction moves the peripheral flange towards the brake bracket and towards the lower surface of the steering arm and wherein rotation of the actuator pin in the second direction moves the peripheral flange away from the brake bracket and away from the lower surface of the steering arm.

14. The apparatus according to claim 13, wherein the stem further comprises an inner end portion located between the peripheral flange and the outer end portion, wherein the inner end portion is elongated and further comprising a brake pad on the stem along the inner end portion.

15. The apparatus according to claim 1, wherein the steering arm comprises a forward end coupled to the tiller, an aftward end coupled to the outboard motor, and a steering tube extending downwardly from the steering arm into the transom bracket.

16. An apparatus for steering an outboard motor with respect to a marine vessel, the apparatus comprising:

a transom bracket configured to support the outboard motor with respect to the marine vessel;

a tiller for manually steering the outboard motor with respect to a steering axis;

a steering arm extending above the transom bracket and coupling the tiller to the outboard motor such that rotation of the tiller causes rotation of the outboard motor with respect to the steering axis; and a copilot device configured to lock the outboard motor in each of a plurality of steering positions relative to the steering axis, wherein the copilot device extends above and is manually operable from above the steering arm;

wherein the copilot device further comprises a brake mechanism located between the steering arm and the transom bracket, wherein movement of the input device into the locked position causes the brake mechanism to lock the outboard motor in the one of the plurality of steering positions and wherein movement of the input device into the unlocked position causes the brake mechanism to unlock the outboard motor with respect to the steering axis; and wherein the brake mechanism comprises a brake bracket mounted on the transom bracket and a flanged bushing that clamps and alternately unclamps onto the brake bracket so as to lock and unlock the outboard motor with respect to the steering axis.

17. The apparatus according to claim 16, wherein the copilot device comprises an input device located above the steering arm, the input device being movable into a locked position in which the outboard motor is locked in one of the plurality of steering positions and an unlocked position in which the outboard motor is steerable relative to the steering axis.

18. The apparatus according to claim 17, wherein the actuator comprises an actuator pin, wherein movement of the input device into the locked position rotates the actuator pin in a first direction, which thereby clamps the flanged bushing onto the brake bracket, and wherein movement of the input device into the unlocked position rotates the actuator pin in an opposite, second direction, which thereby unclamps the flanged bushing from the brake bracket.

19. The apparatus according to claim 18, wherein the actuator pin comprises a threaded fastener that extends along an axis, and wherein the flanged bushing comprises a threaded bore in which the threaded fastener is engaged such that rotation of the actuator pin in the first direction causes the flanged bushing to move axially towards the actuator pin and such that rotation of the actuator pin in the second direction causes the flanged bushing to move axially away from the actuator pin.

* * * * *